US006857476B2

(12) United States Patent
Richards

(10) Patent No.: US 6,857,476 B2
(45) Date of Patent: Feb. 22, 2005

(54) SAND CONTROL SCREEN ASSEMBLY HAVING AN INTERNAL SEAL ELEMENT AND TREATMENT METHOD USING THE SAME

(75) Inventor: William Mark Richards, Frisco, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 74 days.

(21) Appl. No.: 10/342,988

(22) Filed: Jan. 15, 2003

(65) Prior Publication Data

US 2004/0134656 A1 Jul. 15, 2004

(51) Int. Cl.[7] ..... E21B 43/08
(52) U.S. Cl. ..... 166/278; 166/51; 166/227
(58) Field of Search ..... 166/51, 227, 231, 166/233, 235, 278, 115, 202

(56) References Cited

U.S. PATENT DOCUMENTS

| | | | |
|---|---|---|---|
| 2,342,913 A | 2/1944 | Williams et al. | |
| 2,344,909 A | 3/1944 | Williams et al. | |

(List continued on next page.)

FOREIGN PATENT DOCUMENTS

| | | | |
|---|---|---|---|
| EP | 0 431 162 | 6/1991 | |
| EP | 0 617 195 | 9/1994 | |
| EP | 0 955 447 | 11/1999 | |
| EP | 1 132 571 A1 | 9/2001 | ..... E21B/43/267 |
| GB | 2 371 578 | 7/2002 | |
| GB | 2 381 021 A | 4/2003 | |
| GB | 2 381 811 A | 5/2003 | |
| WO | WO 99/12630 | 3/1999 | ..... B01D/29/15 |
| WO | WO 00/61913 | 10/2000 | ..... E21B/43/04 |
| WO | WO 01/14691 | 3/2001 | ..... E21B/43/08 |
| WO | WO 01/44619 | 6/2001 | ..... E21B/43/04 |
| WO | WO 02/10554 A1 | 2/2002 | ..... E21B/43/26 |

OTHER PUBLICATIONS

"Mechanical Fluid–Loss Control Systems Used During Sand Control Operations," H.L. Restarick of Otis Engineering Corp., 1992.
"Sand Control Screens," Halliburton Energy Services, 1994.
"Frac Pack Technology Still Evolving," Charles D. Ebinger of Ely & Associates Inc.; Oil & Gas Journal, Oct. 23, 1995.
"Screenless Single Trip Multizone Sand Control Tool System Saves Rig Time," Travis Hailey and Morris Cox of Haliburton Energy Services, Inc.; and Kirk Johnson of BP Exploration (Alaska), Inc. Society of Petroleum Engineers Inc., Feb., 2000.
"Caps [am] Sand Control Service for Horizontal Completions Improves Gravel Park Reliability and Increases Production Potential from Horizontal Completions," Halliburton Energy Services, Inc., Aug., 2000.

(List continued on next page.)

*Primary Examiner*—Frank Tsay
(74) *Attorney, Agent, or Firm*—Lawrence R. Youst

(57) ABSTRACT

A sand control screen assembly (90) that is positionable within a wellbore comprises a base pipe (92) having a blank pipe section (94) and a perforated section (96) having at least one opening (98) that allows fluid flow therethrough. A filter medium (100) is positioned about the exterior of the base pipe (92) that selectively allows fluid flow therethrough and prevents particulate of a predetermined size from flowing therethrough. An internal seal element (104) is positioned at least partially within the perforated section (96) of the base pipe (92). The internal seal element (104) controls the flow of fluid through the opening (98) of the base pipe (92) such that fluid flow is prevented from the interior to the exterior of the sand control screen assembly (90) but is allowed from the exterior to the interior of the sand control screen assembly (90).

25 Claims, 6 Drawing Sheets

U.S. PATENT DOCUMENTS

| | | | | | |
|---|---|---|---|---|---|
| 3,005,507 | A | * | 10/1961 | Clark Jr. et al. | 175/324 |
| 3,486,558 | A | | 12/1969 | Maxwell | |
| 3,627,046 | A | * | 12/1971 | Miller et al. | 166/278 |
| 3,865,188 | A | * | 2/1975 | Doggett et al. | 166/285 |
| 4,418,754 | A | * | 12/1983 | Stepp | 166/278 |
| 4,494,608 | A | | 1/1985 | Williams et al. | |
| 4,858,690 | A | * | 8/1989 | Rebardi et al. | 166/278 |
| 4,886,432 | A | * | 12/1989 | Kimberlin | 417/478 |
| 4,945,991 | A | | 8/1990 | Jones | 166/278 |
| 5,082,052 | A | | 1/1992 | Jones et al. | 166/51 |
| 5,113,935 | A | | 5/1992 | Jones et al. | 166/51 |
| 5,161,613 | A | | 11/1992 | Jones | 166/242 |
| 5,161,618 | A | | 11/1992 | Jones et al. | 166/308 |
| 5,228,526 | A | * | 7/1993 | Vshivkov et al. | 175/317 |
| 5,333,688 | A | | 8/1994 | Jones et al. | 166/278 |
| 5,343,949 | A | | 9/1994 | Ross et al. | 166/278 |
| 5,355,956 | A | | 10/1994 | Restarick | 166/296 |
| 5,390,966 | A | | 2/1995 | Cox et al. | 285/137.1 |
| 5,419,394 | A | | 5/1995 | Jones | 166/51 |
| 5,443,117 | A | | 8/1995 | Ross | 166/51 |
| 5,476,143 | A | | 12/1995 | Sparlin et al. | 166/233 |
| 5,515,915 | A | | 5/1996 | Jones et al. | 166/51 |
| 5,588,487 | A | | 12/1996 | Bryant | 166/51 |
| 5,636,691 | A | | 6/1997 | Hendrickson et al. | 166/278 |
| 5,676,208 | A | | 10/1997 | Finley | |
| 5,755,286 | A | | 5/1998 | Ebinger | 166/281 |
| 5,842,516 | A | | 12/1998 | Jones | 166/56 |
| 5,848,645 | A | | 12/1998 | Jones | 166/280 |
| 5,865,251 | A | | 2/1999 | Rebardi et al. | 166/278 |
| 5,868,200 | A | | 2/1999 | Bryant et al. | 166/51 |
| 5,890,533 | A | | 4/1999 | Jones | 166/51 |
| 5,921,318 | A | | 7/1999 | Ross | 166/250.17 |
| 5,934,376 | A | | 8/1999 | Nguyen et al. | 166/278 |
| 5,988,285 | A | | 11/1999 | Tucker et al. | 166/373 |
| 6,003,600 | A | | 12/1999 | Nguyen et al. | 166/281 |
| 6,047,773 | A | | 4/2000 | Zeltmann et al. | 166/281 |
| 6,059,032 | A | | 5/2000 | Jones | 166/278 |
| 6,116,343 | A | | 9/2000 | Van Petegem et al. | 166/297 |
| 6,125,933 | A | | 10/2000 | Ross | 166/250.01 |
| 6,220,345 | B1 | | 4/2001 | Jones et al. | 166/51 |
| 6,227,303 | B1 | | 5/2001 | Jones | 166/378 |
| 6,230,803 | B1 | | 5/2001 | Morton et al. | 166/278 |
| 6,302,208 | B1 | | 10/2001 | Walker et al. | 166/278 |
| 6,343,651 | B1 | | 2/2002 | Bixenman | 166/278 |
| 6,371,210 | B1 | | 4/2002 | Bode et al. | |
| 6,457,518 | B1 | | 10/2002 | Castano-Mears et al. | |
| 6,478,091 | B1 | | 11/2002 | Gano | |
| 6,557,634 | B2 | | 5/2003 | Hailey, Jr. et al. | |
| 6,719,051 | B2 | | 4/2004 | Hailey, Jr. et al. | |
| 2002/0074119 | A1 | | 6/2002 | Bixenman et al. | |
| 2002/0125006 | A1 | | 9/2002 | Hailey, Jr. et al. | |
| 2002/0157837 | A1 | | 10/2002 | Bode et al. | 166/334.4 |
| 2002/0189815 | A1 | | 12/2002 | Johnson et al. | |
| 2003/0000701 | A1 | | 1/2003 | Dusterhoft et al. | |
| 2003/0056947 | A1 | | 3/2003 | Cameron | |
| 2003/0056948 | A1 | | 3/2003 | Cameron | |
| 2003/0089496 | A1 | | 5/2003 | Price-Smith et al. | |
| 2003/0141061 | A1 | | 7/2003 | Hailey, Jr. et al. | |
| 2003/0188871 | A1 | | 10/2003 | Dusterhoft et al. | |
| 2004/0035578 | A1 | | 2/2004 | Ross et al. | |
| 2004/0035591 | A1 | | 2/2004 | Echols | |

OTHER PUBLICATIONS

"CAPS$^{am}$ Concentric Annular Packing Service for Sand Control," Halliburton Energy Services, Inc., Dec. 1999.

"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Bambang T. Santoso of Repsol–YPF. Society of Petroleum Engineers, Inc., Mar., 2001.

"QUANTUM Zonal Isolation Tool," pp. 12–13 of Sand Face Completions Catalog.

"Absolute Isolation System (AIS) Components" Halliburton Energy Services, Inc., pp. 5–28 of Downhole Sand Control Components.

"OSCA HPR–ISO System", 1 page, Technical Bulletin.

"PCT International Search Report"; PCT/US2004/000675; 9 pages.

U.S. Appl. No. 10/252,621, Brezinski et al.

"OSCA The ISO System", 1 page, Technical Bulletin.

"OSCA Screen Communication System", 1 page, Technical Bulletin.

"OSCA Pressure Actuated Circulating Valve", 1 page, Technical Bulletin.

* cited by examiner

SAND CONTROL SCREEN ASSEMBLY HAVING AN INTERNAL SEAL ELEMENT AND TREATMENT METHOD USING THE SAME

TECHNICAL FIELD OF THE INVENTION

This invention relates, in general, to a sand control screen assembly positioned in a production interval of a wellbore and, in particular, to a sand control screen assembly having an internal seal element that prevents fluid flow from the interior to the exterior of the sand control screen assembly.

BACKGROUND OF THE INVENTION

It is well known in the subterranean well drilling and completion art that relatively fine particulate materials may be produced during the production of hydrocarbons from a well that traverses an unconsolidated or loosely consolidated formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids using surface processing equipment.

One method for preventing the production of such particulate material is to gravel pack the well adjacent to the unconsolidated or loosely consolidated production interval. In a typical gravel pack completion, a sand control screen is lowered into the wellbore on a work string to a position proximate the desired production interval. A fluid slurry including a liquid carrier and a relatively coarse particulate material, such as sand, gravel or proppants which are typically sized and graded and which are typically referred to herein as gravel, is then pumped down the work string and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

In other cases, it may be desirable to stimulate the formation by, for example, performing a formation fracturing and propping operation prior to or simultaneously with the gravel packing operation. Hydraulic fracturing of a hydrocarbon formation is sometimes necessary to increase the permeability of the formation adjacent the wellbore. According to conventional practice, a fracture fluid such as water, oil, oil/water emulsion, gelled water or gelled oil is pumped down the work string with sufficient volume and pressure to open multiple fractures in the production interval. The fracture fluid may carry a suitable propping agent, such as sand, gravel or proppants, which are typically referred to herein as proppants, into the fractures for the purpose of holding the fractures open following the fracturing operation.

It has been found, however, that following formation treatment operations, the fluid inside the sand control screen tends to leak off into the adjacent formation. This leak off not only results in the loss of the relatively expensive fluid into the formation, but may also result in damage to the gravel pack around the sand control screen and damage to the formation. This fluid leak off is particularly problematic in cases where multiple production intervals within a single wellbore require treatment as the fluid remains in communication with the various formations for an extended period of time.

Therefore, a need has arisen for an apparatus and a treatment method that provide for the treatment of one or more formations traversed by a wellbore. A need has also arisen for such an apparatus and a treatment method that prevent fluid loss into the formations following the treatment process. Further, need has also arisen for such an apparatus and a treatment method that allow for the productions of fluids from the formations following the treatment process.

SUMMARY OF THE INVENTION

The present invention disclosed herein comprises a sand control screen assembly and a treatment method that provide for the treatment of one or more formations traversed by a wellbore. The sand control screen assembly and the treatment method of the present invention prevent fluid loss into the formations following the treatment process. In addition, the sand control screen assembly and the treatment method of the present invention allow for the production of fluids from the formations following the treatment process.

The sand control screen assembly comprises a base pipe having a blank pipe section and a perforated section having at least one opening that allows fluid flow therethrough. A filter medium is positioned about the exterior of the base pipe. The filter medium selectively allows fluid flow therethrough and prevents particulate flow of a predetermined size therethrough. An internal seal element is positioned at least partially within the perforated section of the base pipe. The internal seal element has a sealing position and a non sealing position.

In the sealing position, the internal seal element prevents fluid flow from the interior to the exterior of the sand control screen assembly. In one embodiment, this is achieved by radially outwardly deforming the internal seal element into sealing engagement with the perforated section of the base pipe with a differential pressure across the internal seal element from the interior to the exterior of the sand control screen assembly. In the non sealing position, the internal seal element allows fluid flow from the exterior to the interior of the sand control screen assembly. In one embodiment, this is achieved by radially inwardly deforming the internal seal element out of sealing engagement with the perforated section of the base pipe with a differential pressure across the internal seal element from the exterior to the interior of the sand control screen assembly.

The internal seal element is securably attached within the blank pipe section of the base pipe. In one embodiment, a radially extended portion of the internal seal element is received within a profile within the blank pipe section of the base pipe. In another embodiment, the internal seal element is securably attached within the blank pipe section of the base pipe with an adhesive. In yet another embodiment, a ring is securably attached to the internal seal element. The ring is then securably and sealingly coupled to the blank pipe section of the base pipe. In a further embodiment, a seal ring is securably attached to the internal seal element and an attachment ring securably couples to the blank pipe section of the base pipe to maintain the seal ring in a sealing engagement with the base pipe and position the internal seal element adjacent to the opening.

In another aspect, the present invention comprises a downhole treatment method including the steps of locating a sand control screen assembly within a production interval of a wellbore, the sand control screen assembly including a base pipe having a blank pipe section and a perforated section having at least one opening, a filter medium positioned about an exterior of the base pipe and an internal seal element positioned at least partially within the perforated section of the base pipe, pumping a treatment fluid into the production interval and preventing fluid flow from the interior to the exterior of the sand control screen assembly with the internal seal element that controls fluid flow therethrough.

The present invention also comprises a downhole treatment method including the steps locating the sand control screen assembly within a production interval of a wellbore, taking fluid returns from the exterior to the interior of the sand control screen assembly, preventing fluid loss from the interior to the exterior of the sand control screen assembly with the internal seal element and allowing production fluid flow from the exterior to the interior of the sand control screen assembly.

In this treatment method, the step of taking fluid returns from the exterior to the interior of the sand control screen assembly may involve radially inwardly deforming the internal seal element away from sealing engagement with the perforated section of the base pipe. In addition, the step of preventing fluid loss from the interior to the exterior of the sand control screen assembly with the internal seal element may involve radially outwardly deforming the internal seal element into sealing engagement with the perforated section of the base pipe. Further, the step of allowing production fluid flow from the exterior to the interior of the sand control screen assembly may involve radially inwardly deforming the internal seal element away from sealing engagement with the perforated section of the base pipe.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
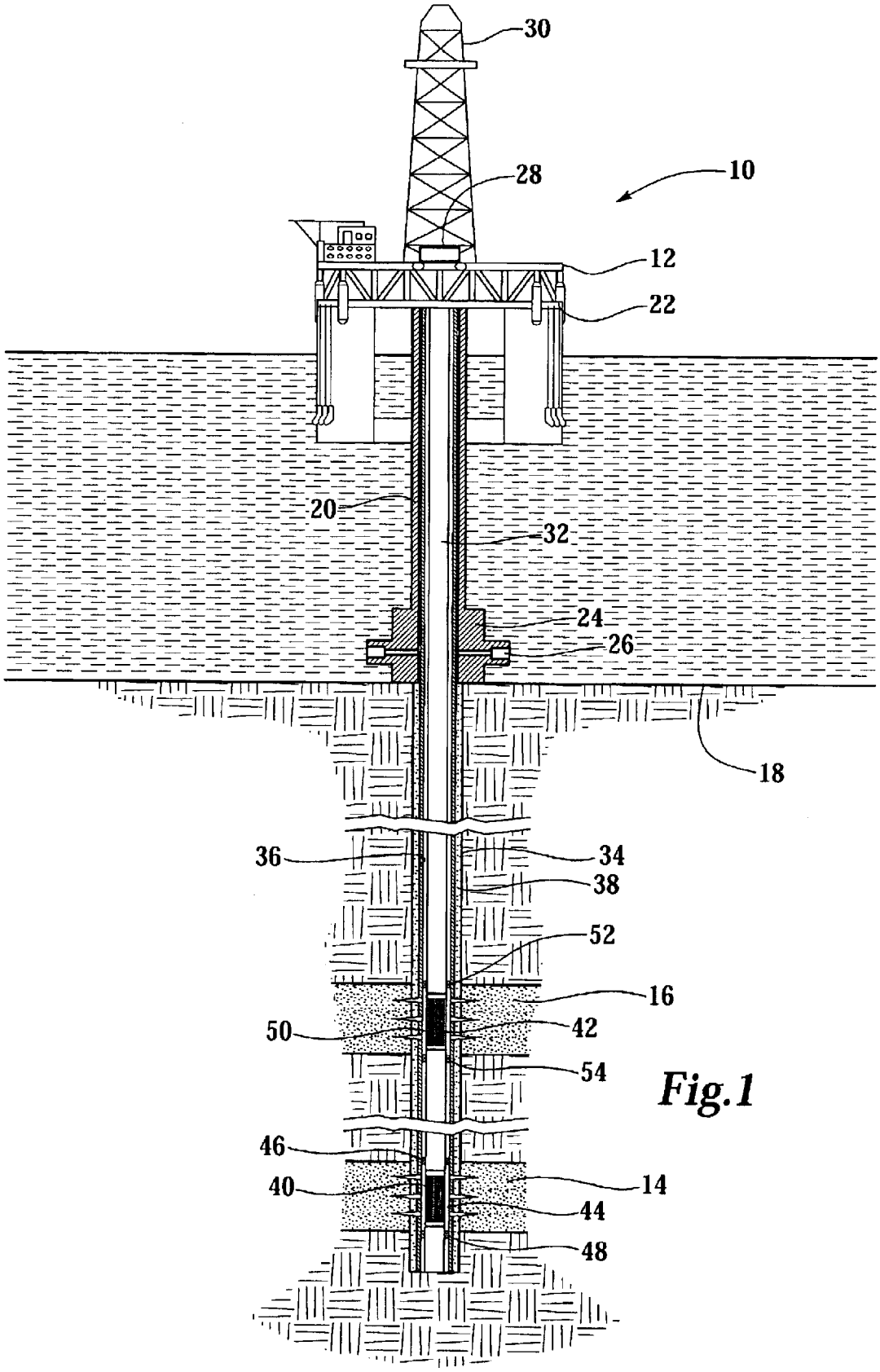
FIG. 1 is a schematic illustration of an offshore oil and gas platform operating a pair of sand control screen assemblies of the present invention.

Referring initially to FIG. 1, a pair of sand control screen assemblies used during the treatment of multiple intervals of a wellbore and operating from an offshore oil and gas platform is schematically illustrated and generally designated 10. A semi-submersible platform 12 is centered over a pair of submerged oil and gas formations 14, 16 located below a sea floor 18. A subsea conduit 20 extends from a deck 22 of the platform 12 to a wellhead installation 24 including blowout preventers 26. Platform 12 has a hoisting apparatus 28 and a derrick 30 for raising and lowering pipe strings such as a work string 32.

A wellbore 34 extends through the various earth strata including formations 14, 16. A casing 36 is cemented within wellbore 34 by cement 38. Work string 32 includes various tools such as a sand control screen assembly 40 which is positioned within production interval 44 between packers 46, 48 and adjacent to formation 14 and a sand control screen assembly 42 which is positioned within production interval 50 between packers 52, 54 and adjacent to formation 16. Once sand control screen assemblies 40, 42 are in the illustrated configuration, a treatment fluid containing sand, gravel, proppants or the like may be pumped down work string 32 such that production intervals 44, 50 and formations 14, 16 may be treated, as described in greater detail below.

Even though FIG. 1 depicts a vertical well, it should be noted by one skilled in the art that the sand control screen assemblies of the present invention are equally well-suited for use in wells having other directional orientations such as deviated wells, inclined wells or horizontal wells. Also, even though FIG. 1 depicts an offshore operation, it should be noted by one skilled in the art that the sand control screen assemblies of the present invention are equally well-suited for use in onshore operations. Also, even though FIG. 1 depicts two formations, it should be understood by one skilled in the art that the treatment processes of the present invention are equally well-suited for use with any number of formations.

Figure 2:
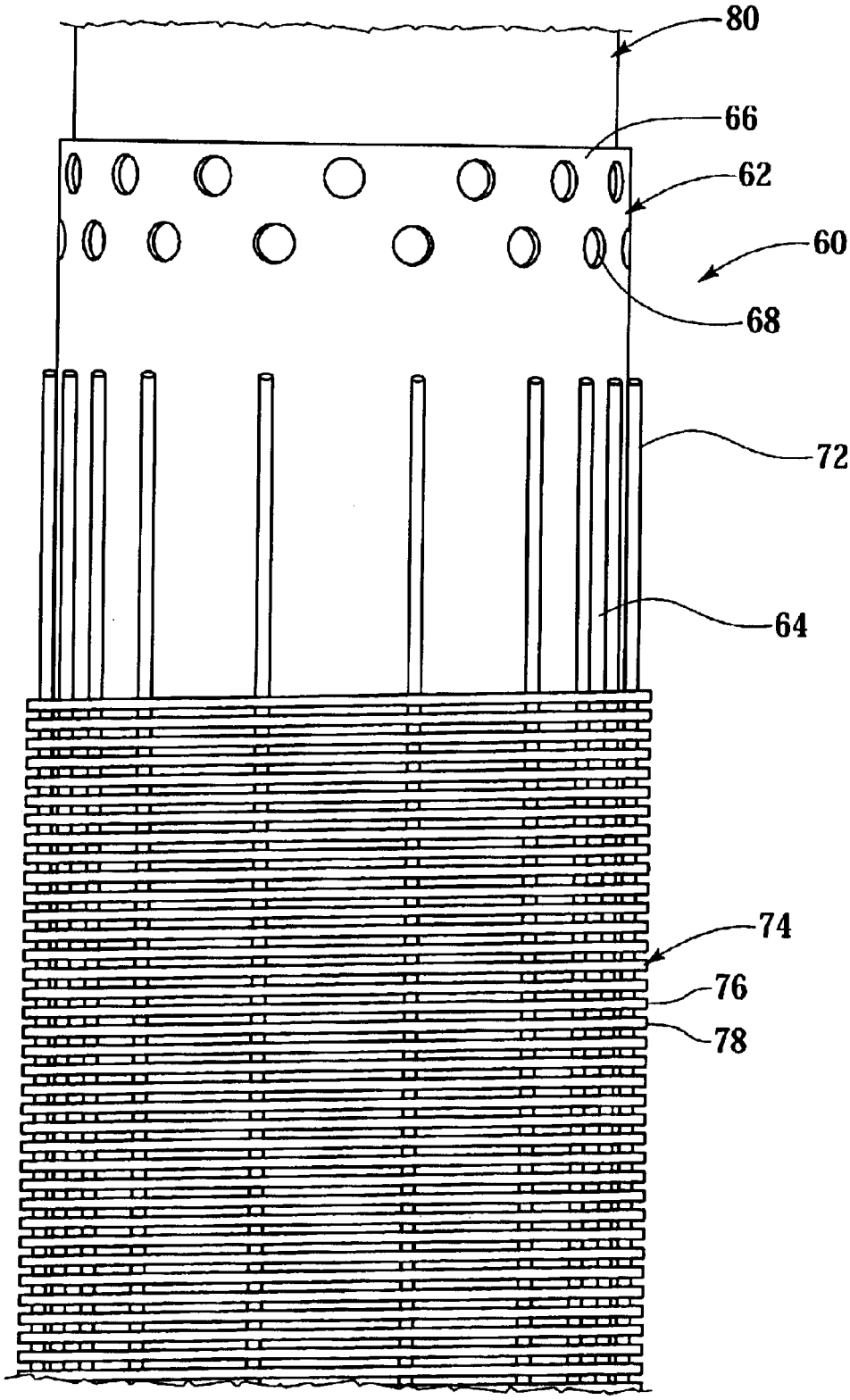
FIG. 2 is a partial cut away view of a sand control screen assembly of the present invention having an internal seal element disposed within a base pipe.

Referring now to FIG. 2, therein is depicted a more detailed illustration a partial cut away view of a sand control screen assembly of the present invention that is generally designated 60. Sand control screen assembly 60 includes a base pipe 62 that has a blank pipe section 64 and a perforated section 66 including a plurality of openings 68 which allow the flow of production fluids into sand control screen assembly 60. The exact number, size and shape of openings 68 are not critical to the present invention, so long as sufficient area is provided for fluid production and the integrity of base pipe 62 is maintained. Accordingly, even though openings 68 are depicted as round, other shaped openings including slots, slits, or any other discontinuity through the wall of base pipe 62 could alternative act as the drainage path for production fluids into sand control screen assembly 60.

Spaced around base pipe 62 is a plurality of ribs 72. Ribs 72 are generally symmetrically distributed about the axis of base pipe 62. Ribs 72 are depicted as having a cylindrical cross section, however, it should be understood by one skilled in the art that ribs 72 may alternatively have a rectangular or triangular cross section or other suitable geometry. Additionally, it should be understood by one skilled in the art that the exact number of ribs 72 will be dependant upon the diameter of base pipe 62 as well as other design characteristics that are well known in the art.

Wrapped around ribs 72 is a screen wire 74. Screen wire 74 forms a plurality of turns, such as turn 76 and turn 78. Between each of the turns is a gap through which formation fluids flow. The number of turns and the gap between the turns are determined based upon the characteristics of the formation from which fluid is being produced and the size of the gravel to be used during the gravel packing operation. Together, ribs 72 and screen wire 74 may form a sand control screen jacket that is attached to base pipe 62 by welding or other suitable techniques.

It should be understood by those skilled in the art that even though FIG. 2 has depicted a wire wrapped sand control screen, other types of filter media could alternatively be used in conjunction with the apparatus of the present invention, including, but not limited to, a fluid-porous, particulate restricting material such as a plurality of layers of a wire mesh that are diffusion bonded or sintered together to form a porous wire mesh screen designed to allow fluid flow therethrough but prevent the flow of particulate materials of a predetermined size from passing therethrough.

Positioned within perforated section 66 of base pipe 62 is an internal seal element 80 that prevents fluid flow from the interior to the exterior of sand control screen assembly 60. Preferably, internal seal element 80 is formed from an elastomer such as a natural or synthetic rubber or other suitable polymer such as a high polymer having the ability to partially or completely recover to its original shape after deforming forces are removed. More generally, internal seal element 80 may be constructed from any material or have any configuration that will allow internal seal element 80 to prevent fluid flow from the interior to the exterior of sand control screen assembly 60 when the pressure inside of sand control screen assembly 60 is greater than the pressure outside of sand control screen assembly 60 and to allow fluid flow from the exterior to the interior of sand control screen assembly 60 when the differential pressure across internal seal element 80 from the exterior to the interior of sand control screen assembly 60 exceeds a predetermined level.

Accordingly, when internal seal element 80 is positioned within base pipe 62 during a treatment process such as a gravel pack, a frac pack or a fracture operation, treatment fluid returns are allowed to flow into sand control screen assembly 60 by radially inwardly deforming internal seal element 80 away from sealing engagement with the interior of base pipe 62 and openings 68. Also, when internal seal element 80 is positioned within base pipe 62 following a treatment process, fluids in the wellbore are prevented from flowing out of sand control screen assembly 60 by radially outwardly deforming internal seal element 80 into sealing engagement with the interior of base pipe 62 and openings 68. Additionally, when internal seal element 80 is positioned within base pipe 62 during production, production fluids are allowed to flow into sand control screen assembly 60 by radially inwardly deforming internal seal element 80 away from sealing engagement with the interior of base pipe 62 and openings 68.

Figure 3:
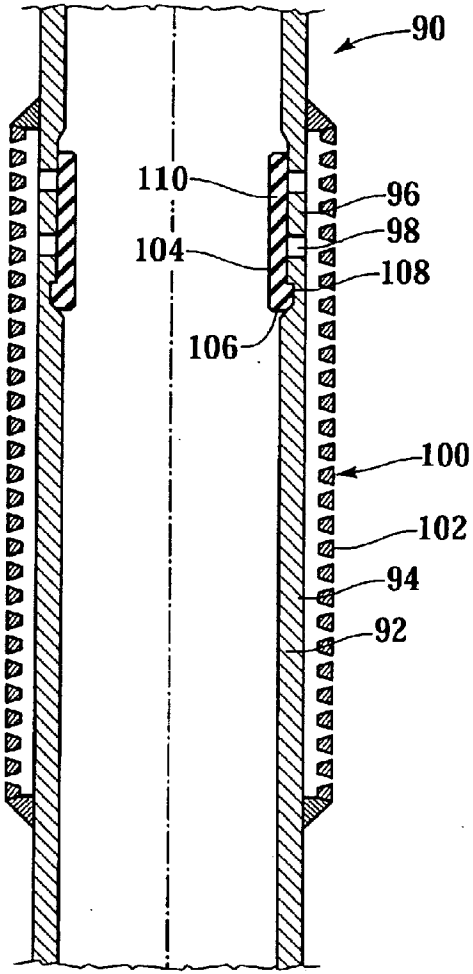
FIG. 3 is a cross sectional view of a sand control screen assembly of the present invention having an internal seal element.

Referring now to FIG. 3, therein is depicted a sand control screen assembly of the present invention that is generally designated 90. Sand control screen assembly 90 includes base pipe 92 that has a blank pipe section 94 and a perforated section 96 having a plurality of openings 98. Positioned on the exterior of base pipe 92 is a sand control screen jacket 100 including a plurality of ribs (not pictured) and a screen wire 102.

Positioned within base pipe 92 is an internal seal element 104 that prevents fluid flow from the interior to the exterior of sand control screen assembly 90. In the illustrated embodiment, a radially extended portion 106 of internal seal element 104 is securably mounted within a receiving profile 108 on the interior of blank pipe section 94 of base pipe 92. Preferably, an adhesive or other suitable bonding agent is used to further secure radially extended portion 106 of internal seal element 104 within receiving profile 108.

Importantly, the sealing portion 110 of internal seal element 104 has no such bonding agents associated therewith as sealing portion 110 of internal seal element 104 is radially inwardly deformable away from sealing engagement with the interior of base pipe 92 and openings 98 to allow fluid flow from the exterior to the interior of sand control screen assembly 90. Accordingly, internal seal element 104 allows for treatment fluid returns during a treatment process and for fluid production once the well is online. In addition, internal seal element 104 prevents fluid loss into the formation after the treatment process but before the well is brought online as the fluids within sand control screen assembly 90 radially outwardly deform sealing portion 110 of internal seal element 104 into sealing engagement with the interior of perforated section 96 of base pipe 92 and openings 98.

Figure 4:
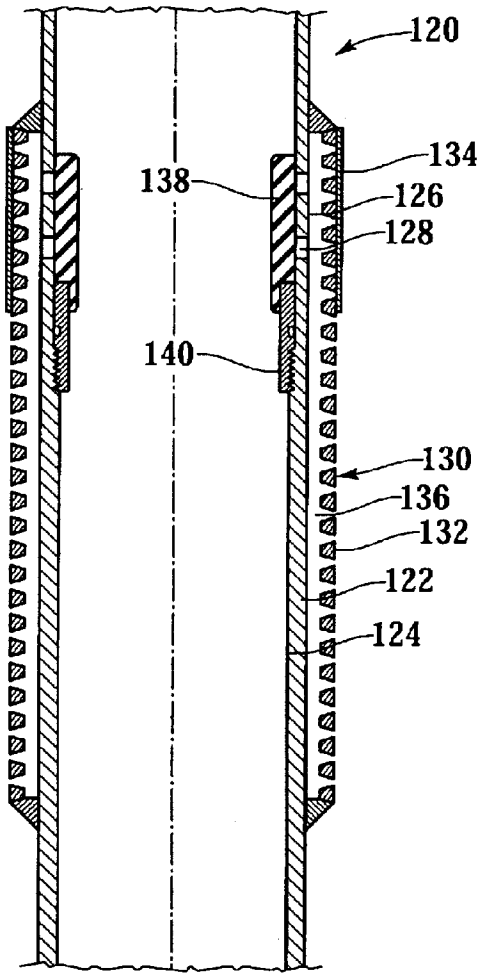
FIG. 4 is a cross sectional view of an alternate embodiment of a sand control screen assembly of the present invention having an internal seal element.

Referring now to FIG. 4, therein is depicted a sand control screen assembly of the present invention that is generally designated 120. Sand control screen assembly 120 includes base pipe 122 that has a blank pipe section 124 and a perforated section 126 having a plurality of openings 128. Positioned on the exterior of base pipe 122 is a sand control screen jacket 130 including a plurality of ribs (not pictured) and a screen wire 132. Positioned exteriorly around the portion of sand control screen jacket 130 adjacent to perforated section 126 of base pipe 122 is a non perforated protective shroud 134. Protective shroud 134 prevents the inflow of fluids directly through sand control screen jacket 130 and into openings 128 and instead requires that inflowing fluids travel in an annulus 136 between screen wire 132 and base pipe 122.

Positioned within base pipe 122 is an internal seal element 138 that prevents fluid flow from the interior to the exterior of the sand control screen assembly 120. In the illustrated embodiment, internal seal element 138 is securably attached to a threaded ring 140 using an adhesive or other suitable bonding agent. Threaded ring 140 is threadably and sealing coupled to the interior of blank pipe section 124 of base pipe 122.

In operation, internal seal element 138 is radially inwardly deformable away from sealing engagement with the interior of perforated section 126 of base pipe 122 and openings 128 to allow fluid flow from the exterior to the interior of sand control screen assembly 120. For example, internal seal element 138 allows for treatment fluid returns during a treatment process and for fluid production once the well is online. In addition, internal seal element 138 prevents fluid loss into the formation after the treatment process but before the well is brought online as the fluids within sand control screen assembly 120 radially outwardly deform internal seal element 138 into sealing engagement with the interior of perforated section 126 of base pipe 122 and openings 128.

Figure 5:
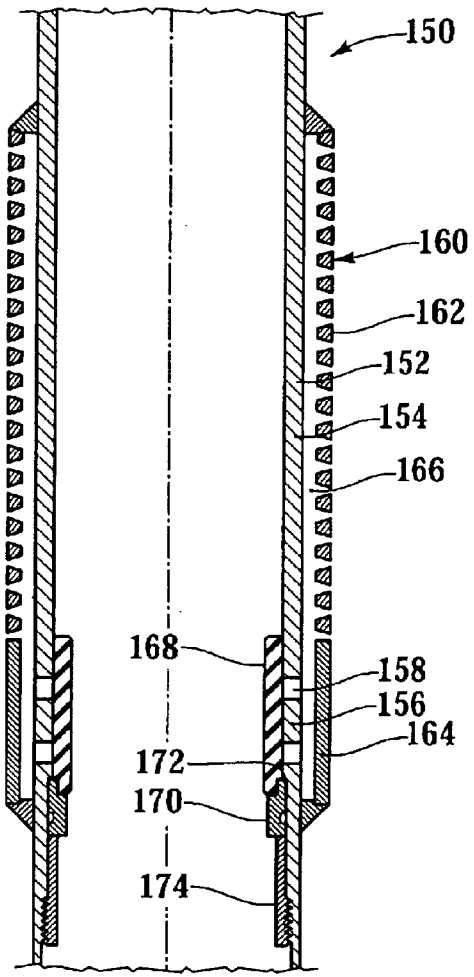
FIG. 5 is a cross sectional view of another alternate embodiment of a sand control screen assembly of the present invention having an internal seal element.

Referring now to FIG. 5, therein is depicted a sand control screen assembly of the present invention that is generally designated 150. Sand control screen assembly 150 includes base pipe 152 that has a blank pipe section 154 and a perforated section 156 having a plurality of openings 158. Positioned on the exterior of base pipe 152 is a sand control screen jacket 160 including a plurality of ribs (not pictured) and a screen wire 162. In the region adjacent to perforated section 156 of base pipe 152, sand control screen jacket 160 includes a blank pipe section 164 which prevents the inflow of fluids directly through sand control screen jacket 160 and into openings 158 and instead requires that inflowing fluids travel in an annulus 166 between screen wire 162 and base pipe 152.

Positioned within base pipe 152 is an internal seal element 168 that prevents fluid flow from the interior to the exterior of the sand control screen assembly 150. In the illustrated embodiment, internal seal element 168 is securably attached to a seal ring 170 using an adhesive or other suitable bonding agent. Seal ring 170 is installed against a shoulder 172 on the interior of base pipe 152 and provides a sealing engagement with the interior of base pipe 152. Internal seal element 168 and seal ring 170 are secured in place with a threaded ring 174 that is threadably coupled to the interior of base pipe 152.

In operation, internal seal element 168 is radially inwardly deformable away from sealing engagement with the interior of perforated section 156 of base pipe 152 and openings 158 to allow fluid flow from the exterior to the interior of sand control screen assembly 150. For example, internal seal element 168 allows for treatment fluid returns during a treatment process and for fluid production once the well is online. In addition, internal seal element 168 prevents fluid loss into the formation after the treatment process but before the well is brought online as the fluids within sand control screen assembly 150 radially outwardly deform internal seal element 168 into sealing engagement with the interior of perforated section 156 of base pipe 152 and openings 158.

Figure 6:
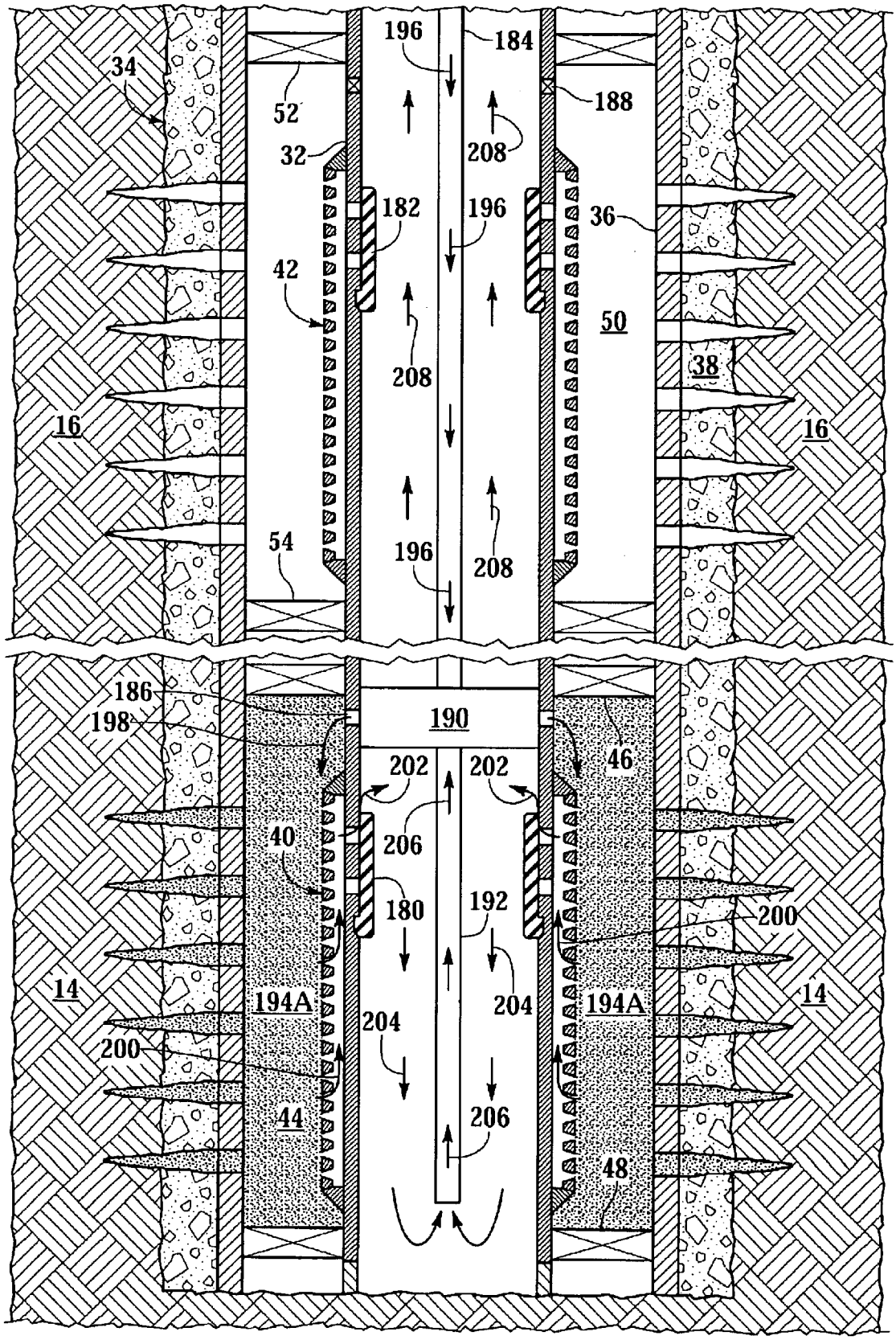
FIG. 6 is a half sectional view of a downhole production environment including a pair of sand control screen assemblies of the present invention during a first phase of a downhole treatment process.

Referring now to FIG. 6, therein is depicted in more detail the downhole environment described above with reference to FIG. 1 during a treatment process such as a gravel pack, a fracture operation, a frac pack or the like. As illustrated, sand control screen assembly 40 including internal seal element 180, is positioned within casing 36 and is adjacent to formation 14. Likewise, sand control screen assembly 42 including internal seal element 182, is positioned within casing 36 and is adjacent to formation 16. A service tool 184 is positioned within work string 32.

To begin the completion process, production interval 44 adjacent to formation 14 is isolated. Packer 46 seals the near or uphole end of production interval 44 and packer 48 seals the far or downhole end of production interval 44. Likewise, production interval 50 adjacent to formation 16 is isolated. Packer 52 seals the near end of production interval 50 and packer 54 seals the far end of production interval 50. Work string 32 includes cross-over ports 186, 188 that provide a fluid communication path from the interior of work string 32 to production intervals 44, 50, respectively. Preferably, fluid flow through cross-over ports 186, 188 is controlled by suitable valves that are opened and closed by conventional means. Service tool 184 includes a cross-over assembly 190 and a wish pipe 192.

Next, the desired treatment process may be performed. As an example, when the treatment process is a fracture operation, the objective is to enhance the permeability of the treated formation by delivering a fluid slurry containing proppants at a high flow rate and in a large volume above the fracture gradient of the formation such that fractures may be formed within the formation and held open by proppants. In addition, if the treatment process is a frac pack, after fracturing, the objective is to prevent the production of fines by packing the production interval with proppants. Similarly, if the treatment process is a gravel pack, the objective is to prevent the production of fines by packing the production interval with gravel, without fracturing the adjacent formation.

The following example will describe the operation of the present invention during a gravel pack operation. Sand control screen assemblies 40, 42 each have a filter medium associated therewith that is designed to allow fluid to flow therethrough but prevent particulate matter of a sufficient size from flowing therethrough. During the gravel pack, a treatment fluid, in this case a fluid slurry containing gravel 194, is pumped downhole in service tool 184, as indicated by arrows 196, and into production interval 44 via cross-over assembly 190, as indicated by arrows 198. As the fluid slurry containing gravel 194 travels to the far end of production interval 44, gravel 194 drops out of the slurry and builds up from formation 14, filling the perforations and production interval 44 around sand control screen assembly 40 forming gravel pack 194A. While some of the carrier fluid in the slurry may leak off into formation 14, the remainder of the carrier fluid enters sand control screen assembly 40, as indicated by arrows 200 and radially inwardly deforms internal seal element 180 to enter the interior of sand control screen assembly 40, as indicated by arrows 202. The fluid flowing back through sand control screen assembly 40, as indicated by arrows 204, enters wash pipe 192, as indicated by arrows 206, passes through cross-over assembly 190 and flows back to the surface, as indicated by arrows 208.

Figure 7:
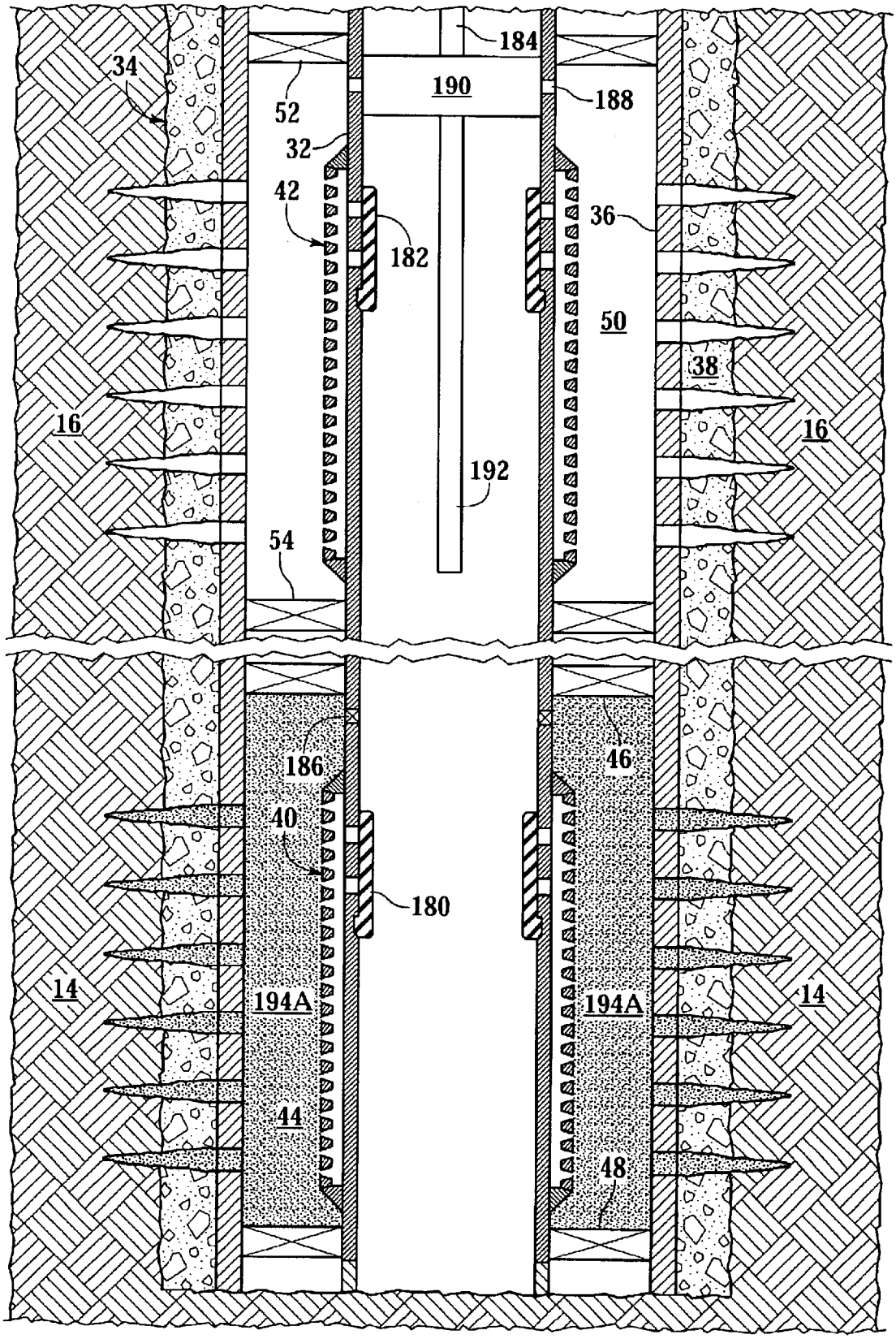
FIG. 7 is a half sectional view of a downhole product environment including a pair of sand control screen assemblies of the present invention during a second phase of a downhole treatment process.

After the gravel packing operation of production interval 44 is complete, service tool 184 including cross-over assembly 190 and wash pipe 192 may be moved uphole such that other production intervals may be gravel packed, such as production interval 50, as best seen in FIG. 7. As the distance between formation 14 and formation 16 may be hundreds or even thousands of feet and as there may be any number of production intervals that require gravel packing, there may be a considerable amount of time between the gravel packing of production interval 44 and eventual production from formation 14. It has been found that in conventional completions, considerable fluid loss may occur from the interior of sand control screen assembly 40 through gravel pack 194A and into formation 14. This fluid loss is not only costly but may also damage gravel pack 194A, formation 14 or both. Using sand control screen assembly 40, however, prevents such fluid loss due to internal seal element 180 positioned within sand control screen assembly 40. Accordingly, using sand control screen assembly 40 only saves the expense associated with fluid loss but also protects gravel pack 194A and formation 14 from the damage caused by fluid loss.

Figure 8:
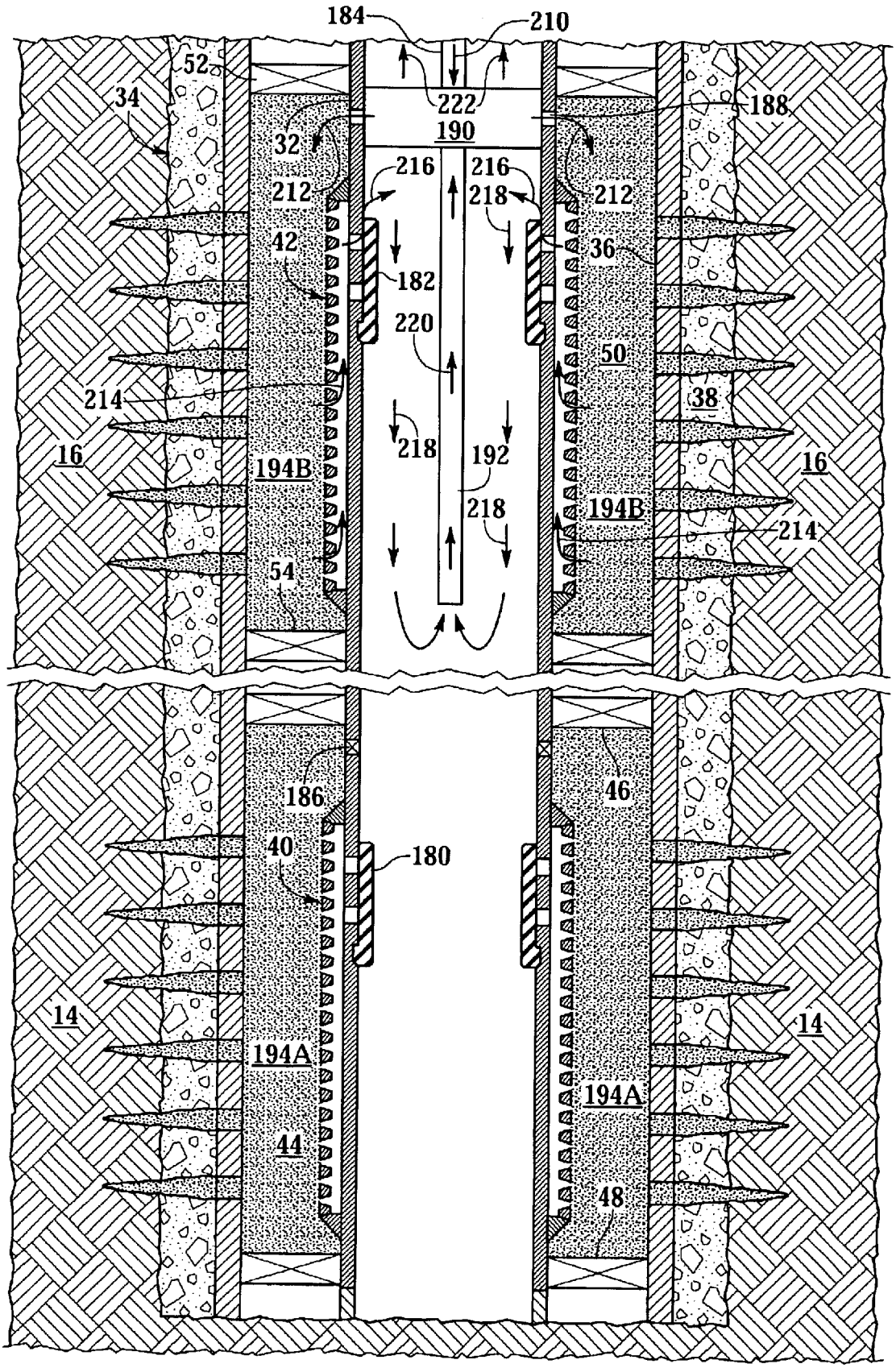
FIG. 8 is a half sectional view of a downhole production environment including a pair of sand control screen assemblies of the present invention during a third phase of a downhole treatment process.

Referring now to FIG. 8, the process of gravel packing production interval 50 is depicted. The fluid slurry containing gravel 194 is pumped downhole through service tool 184, as indicated by arrows 210, and into production interval 50 via cross-over assembly 190 and cross-over ports 188, as indicated by arrows 212. As the fluid slurry containing gravel 194 travels to the far end of production interval 50, the gravel 194 drops out of the slurry and builds up from formation 16, filling the perforations and production interval 50 around sand control screen assembly 42 forming gravel pack 194B. While some of the carrier fluid in the slurry may leak off into formation 16, the remainder of the carrier fluid enters sand control screen assembly 42, as indicated by arrows 214 and radially inwardly deforms internal seal element 182 to enter the interior of sand control screen assembly 42, as indicated by arrows 216. The fluid flowing back through sand control screen assembly 42, as indicated by arrows 218, enters wash pipe 192, as indicated by arrows 220, and passes through cross-over assembly 190 for return to the surface, as indicated by arrows 222. Once gravel pack 194B is complete, cross-over assembly 190 may again be repositioned uphole to gravel pack additional production intervals or retrieved to the surface. As explained above, using sand control screen assembly 42 prevents fluid loss from the interior of sand control screen assembly 42 into production interval 50 and formation 16 during such subsequent operations.

As should be apparent to those skilled in the art, even though FIGS. 6–8 present the treatment of multiple intervals of a wellbore in a vertical orientation with packers at the top and bottom of the production intervals, these figures are intended to also represent wellbores that have alternate directional orientations such as inclined wellbores and horizontal wellbores. In the horizontal orientation, for example, packer 46 is at the heel of production interval 44 and packer 48 is at the toe of production interval 44. Likewise, while multiple production intervals have been described as being treated during a single trip, the methods described above are also suitable for treating a single production interval traversed by a wellbore or may be accomplished in multiple trips into a wellbore.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control screen assembly positionable within a wellbore comprising:

a base pipe having a blank pipe section and a perforated section having at least one opening that allows fluid flow therethrough;

a filter medium positioned about the exterior of the base pipe, the filter medium selectively allowing fluid flow therethrough and preventing particulate flow of a predetermined size therethrough; and an internal seal element positioned at least partially within the perforated section of the base pipe that controls fluid flow through the opening of the base pipe.

2. The sand control screen assembly as recited in claim 1 wherein the internal seal element prevents fluid flow from the interior to the exterior of the sand control screen assembly and allows fluid flow from the exterior to the interior of the sand control screen assembly.

3. The sand control screen assembly as recited in claim 1 wherein the internal seal element is securably attached within the blank pipe section of the base pipe.

4. The sand control screen assembly as recited in claim 3 wherein a radially extended portion of the internal seal element is received within a profile within the blank pipe section of the base pipe.

5. The sand control screen assembly as recited in claim 3 wherein the internal seal element is securably attached within the blank pipe section of the base pipe with an adhesive.

6. The sand control screen assembly as recited in claim 1 further comprising a ring that is securably attached to the internal seal element, the ring securably and sealingly couples to the blank pipe section of the base pipe.

7. The sand control screen assembly as recited in claim 1 further comprising a seal ring that is securably attached to the internal seal element and an attachment ring that securably couples to the blank pipe section of the base pipe to maintain the seal ring in a sealing engagement with the base pipe and position the internal seal element adjacent to the opening.

8. The sand control screen assembly as recited in claim 1 wherein the internal seal element has a sealing position wherein fluid flow from the interior to the exterior of the sand control screen assembly is prevented and a non sealing position wherein fluid flow from the exterior to the interior of the sand control screen assembly is allowed.

9. The sand control screen assembly as recited in claim 8 wherein the internal seal element is radially inwardly deformed in the non sealing position.

10. The sand control screen assembly as recited in claim 8 wherein the internal seal element is radially outwardly deformed in the sealing position.

11. A sand control screen assembly positionable within a wellbore comprising:

a base pipe having a blank pipe section and a perforated section having at least one opening that allows fluid flow therethrough;

a filter medium positioned about the exterior of the base pipe, the filter medium selectively allowing fluid flow therethrough and preventing particulate flow of a predetermined size therethrough; and an internal seal element positioned at least partially within the perforated section of the base pipe, the internal seal element having a sealing position wherein fluid flow from the interior to the exterior of the sand control screen assembly is prevented and a non sealing position wherein fluid flow from the exterior to the interior of the sand control screen assembly is allowed, in the sealing position, the internal seal element is radially outwardly deformed and in the non sealing position, the internal seal element is radially inwardly deformed.

12. The sand control screen assembly as recited in claim 11 wherein the internal seal element is securably attached within the blank pipe section of the base pipe.

13. The sand control screen assembly as recited in claim 12 wherein a radially extended portion of the internal seal element is received within a profile within the blank pipe section of the base pipe.

14. The sand control screen assembly as recited in claim 12 wherein the internal seal element is securably attached within the blank pipe section of the base pipe with an adhesive.

15. The sand control screen assembly as recited in claim 11 further comprising a ring that is securably attached to the internal seal element, the ring securably and sealingly couples to the blank pipe section of the base pipe.

16. The sand control screen assembly as recited in claim 11 further comprising a seal ring that is securably attached to the internal seal element and an attachment ring that securably couples to the blank pipe section of the base pipe to maintain the seal ring in a sealing engagement with the base pipe and position the internal seal element adjacent to the opening.

17. A downhole treatment method comprising the steps of:

locating a sand control screen assembly within a production interval of a wellbore, the sand control screen assembly including a base pipe having a blank pipe section and a perforated section having at least one opening, a filter medium positioned about an exterior of the base pipe and an internal seal element positioned at least partially within the perforated section of the base pipe;

pumping a treatment fluid into the production interval; and preventing fluid flow from the interior to the exterior of the sand control screen assembly with the internal seal element that controls fluid flow therethrough.

18. The method as recited in claim 17 wherein the step of preventing fluid flow from the interior to the exterior of the sand control screen assembly further comprises radially outwardly deforming the internal seal element into sealing engagement with the perforated section of the base pipe.

19. The method as recited in claim 17 further comprising the step of allowing fluid flow from the exterior to the interior of the sand control screen assembly.

20. The method as recited in claim 19 wherein the step of allowing fluid flow from the exterior to the interior of the sand control screen assembly further comprises radially inwardly deforming the internal seal element away from sealing engagement with the perforated section of the base pipe.

21. The method as recited in claim 17 further comprising the step of continuing to prevent fluid flow from the interior to the exterior of the sand control screen assembly after terminating the pumping of the treatment fluid into the production interval.

22. A downhole treatment method comprising the steps of:

locating a sand control screen assembly within a production interval of a wellbore, the sand control screen assembly including a base pipe having a blank pipe section and a perforated section having at least one opening, a filter medium positioned about an exterior of the base pipe and an internal seal element positioned at least partially within the perforated section of the base pipe;

pumping a treatment fluid into the production interval;

taking fluid returns from the exterior to the interior of the sand control screen assembly;

preventing fluid loss from the interior to the exterior of the sand control screen assembly with the internal seal element; and allowing production fluid flow from the exterior to the interior of the sand control screen assembly.

23. The method as recited in claim 22 wherein the step of taking fluid returns from the exterior to the interior of the sand control screen assembly further comprises radially inwardly deforming the internal seal element away from sealing engagement with the perforated section of the base pipe.

24. The method as recited in claim 22 wherein the step of preventing fluid loss from the interior to the exterior of the sand control screen assembly with the internal seal element further comprises radially outwardly deforming the internal seal element into sealing engagement with the perforated section of the base pipe.

25. The method as recited in claim 22 wherein the step of allowing production fluid flow from the exterior to the interior of the sand control screen assembly further comprises radially inwardly deforming the internal seal element away from sealing engagement with the perforated section of the base pipe.

* * * * *